US005237934A

United States Patent [19]

Rhodes

[11] Patent Number: 5,237,934

[45] Date of Patent: Aug. 24, 1993

[54] END CAP GATE SAMPLING DEVICE

[75] Inventor: Wayne A. Rhodes, Luray, Tenn.

[73] Assignee: Touchstone, Inc., Jackson, Tex.

[21] Appl. No.: 12,337

[22] Filed: Feb. 2, 1993

[51] Int. Cl.[5] ..... B61D 7/20

[52] U.S. Cl. ..... 105/299; 105/282.1; 105/308.1; 105/293; 105/296; 105/311.1; 105/313

[58] Field of Search ..... 105/282.1, 286, 288, 105/296, 297, 299, 308.1, 310.2, 293, 280, 282.2, 282.3, 313, 311.1, 311.2; 222/559, 560, 561, 153; 298/27; 406/130

[56] References Cited

U.S. PATENT DOCUMENTS

| | | | |
|---|---|---|---|
| 3,561,368 | 2/1971 | Giesking | 105/282.1 |
| 4,695,207 | 9/1987 | Miller | 105/299 |
| 5,000,358 | 3/1991 | Dugge | 105/282.1 |
| 5,060,579 | 10/1991 | Johnson et al. | 105/282.1 |
| 5,115,748 | 5/1992 | Westlake | 105/299 |

*Primary Examiner*—Mark T. Le
*Attorney, Agent, or Firm*—Head & Johnson

[57] ABSTRACT

The present invention is a control device that allows an operator to partially open a gate valve found at the bottom of a railway freight car hopper in order to obtain a sample of a flowable particulate or granular product contained within the hopper but preventing the gate valve from fully opening so as to partially unload the hopper. The device is provided with a rotatable operating shaft having attaching to it a structure for opening and closing the gate valve in response to rotation of the operating shaft. The operating shaft is provided with two ends that extend through end panels of the hopper. One of the two ends is provided with a lockable sample control handle and the second of the two ends is provided with an angled slot by which a lockable control handle movably attaches. The angled slot allows the operating shaft to be rotated when the control handle is locked closed by unlocking and turning the sample control handle. The limited rotation of the operating shaft allowed by the angled slot is sufficient to partially open the gate valve in order that the sample be obtained. However, the gate valve cannot open fully as long as the control handle is locked closed because the angled slot limits rotation of the operating shaft.

8 Claims, 4 Drawing Sheets

END CAP GATE SAMPLING DEVICE

BACKGROUND OF THE INVENTION

1. Field of the Invention

The present invention relates to an improved control device for obtaining samples from hoppers of railroad cars via an unloading gate valve arrangement.

2. Description of the Related Art

This invention is an improved device that allows a sample to be obtained from a railroad car via an unloading gate valve without fully opening the gate valve.

Railroad cars used in transporting plastic pellets or granular materials are normally provided with hoppers having a hopper discharge slot located at the bottom of each hopper. The discharge slot allows the material contained within the railroad car hopper to be unloaded. Typically, a pair of gate valves, such as the ones disclosed in U.S. Pat. No. 5,060,579 issued Oct. 29, 1991 to James W. Johnson, et al, are provided below each discharge slot as a means of opening and closing the discharge slot. The gate valves are opened and closed by means of two pairs of control handles, with one pair of handles located on either side of the railroad car. The control handles are connected to and serve to rotate a pair of operating shafts located adjacent and parallel to the discharge slot with one operating shaft located on either side of the discharge slot. The operating shafts are attached to and associated with one of the gate valves so that rotation of the operating shafts causes the gate valves to open or close, depending on the direction of rotation.

Whenever a railroad car is loaded and being prepared for shipment, the gate valves are locked in a "closed" position by locking means and the locking means are secured by seals to ensure that the shipment is not tampered with in transit. The locking means for locking the gate valves usually function by immobilizing the pair of control handles located on each side of the railroad car so that the gate valves cannot be opened. After the control handles are immobilized, seals are attached to the locking means in such a way that the seals on both sides of the railroad car must be broken for the control handles to be turned in order to open the gate valves.

Whenever the railroad car reaches its designation, the receiving agent will check the seals to make sure they are intact and will sample the load in order to assure himself of the identity and the quality of the materials before accepting the shipment and authorizing its unloading. With present control devices, it is difficult to slightly open one of the gate valves in order to obtain a sample. Thus, attempts to obtain a sample with the present gate control devices can result in partial unloading of the railroad car.

The present invention is an improved control device that allows a sample to be obtained via a gate valve by first unlocking the control handles on only one side of the railroad car and then turning one specialized control handle, i.e. a sample control handle. As the sample control handle is turned, its attached operating shaft rotates, thus, slightly opening its associating gate valve. Although the operating shaft which is being rotated connects to one of the control handles of the opposite locked pair, the operating shaft is connected thereto by means of an angled slot which allows the operating shaft to rotate sufficiently for its associating gate valve to be cracked open and a sample to be obtained through the partially opened gate valve.

3. Cross Reference to Related Applications

This application constitutes an improvement over application Ser. No. 07/882,074 filed on May 12, 1992, U.S. Pat. No. 5,188,486, for a "Quik-Loc End Arrangement For Pneumatic Gates" by the inventor of the present invention.

SUMMARY OF THE INVENTION

The present invention is an improved control device for partially opening gate valves provided at the bottom discharge slot of a railroad car hopper so that a sample of the material contained within the hopper can be obtained. At least one rotatable operating shaft is provided adjacent to and parallel with the discharge slot. Means attaching to each operating shaft serve to open and close an associating gate valve in response to rotation of the operating shaft. Each operating shaft has two opposite ends that extend through end panels of the hopper. One end of each operating shaft is provided with a lockable sample control handle, and an opposite second end of each operating shaft is provided with an angled slot whereby a lockable control handle movably attaches by means of a bolt or other suitable fastening means. The angled slot allows the operating shaft to be rotated slightly by turning the sample control handle while the control handle is in a locked closed position. The slight rotation of the operating shaft causes its associating gate valve to partially open so that a sample can be obtained through the gate valve without danger of the gate valve fully opening and, thereby, partially unloading the hopper.

DETAILED DESCRIPTION OF THE PREFERRED EMBODIMENTS

Figure 1:
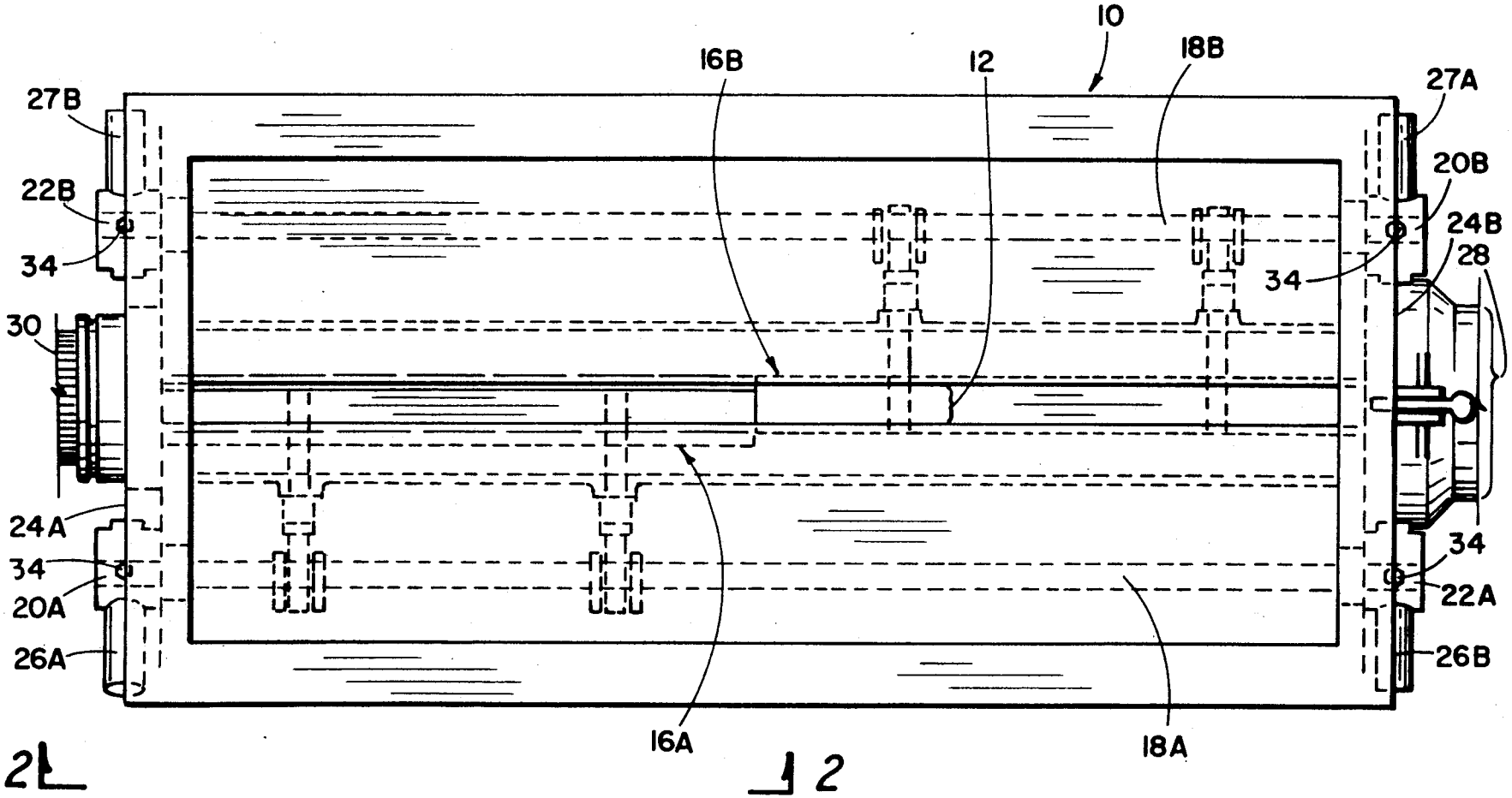
FIG. 1 is a top plan view of a railroad car hopper employing an end cap gate sampling device constructed according to a preferred embodiment of the present invention.
Figure 2:
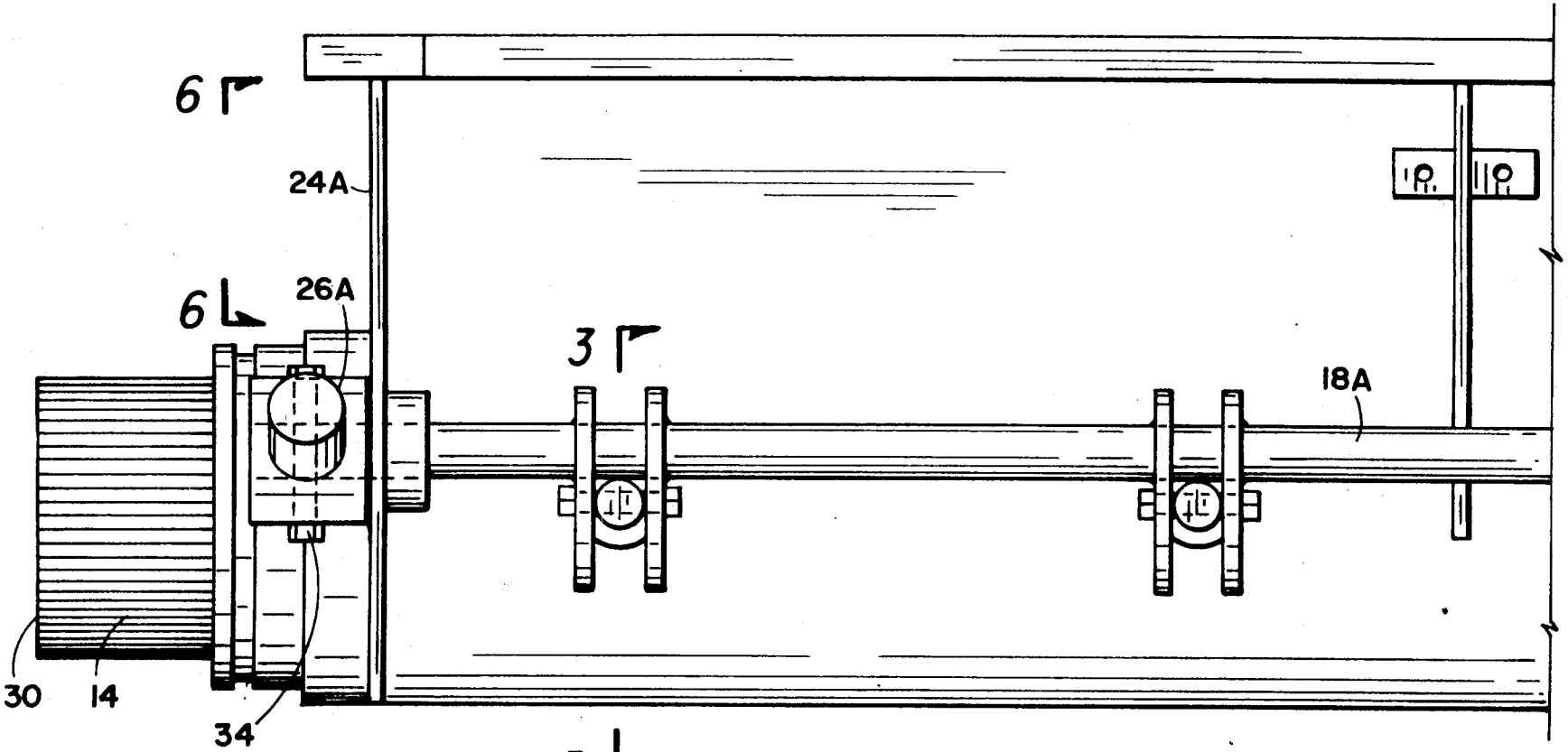
FIG. 2 is a partial side elevation taken along line 2—2 of FIG. 1.
Figure 3:
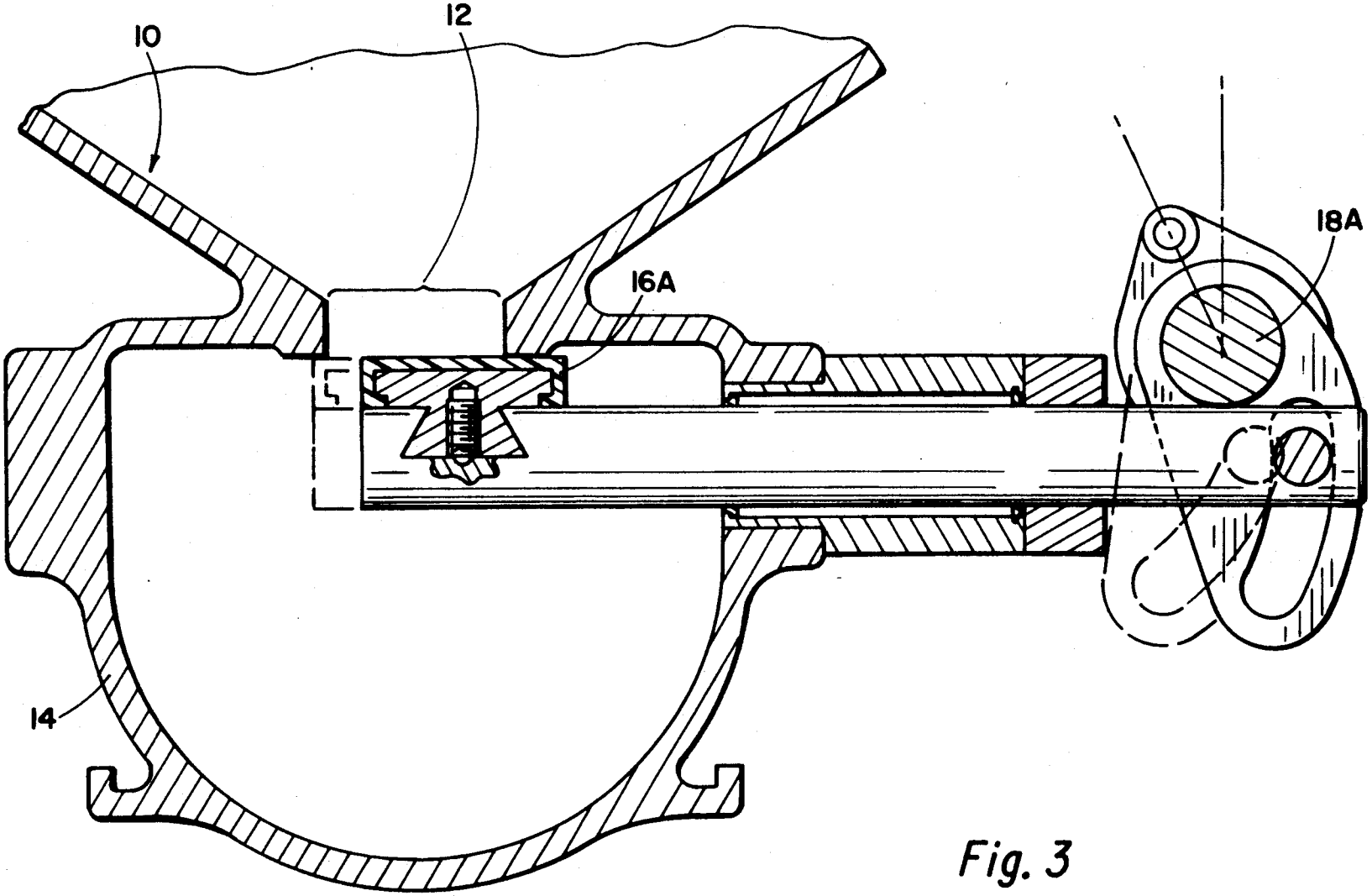
FIG. 3 is a cross-sectional view taken along line 3—3 of FIG. 2.

Referring now to the drawings and initially to FIG. 1, there is illustrated a top plan view of a railway car hopper 10 or other similar carrier. As best seen in FIGS. 1 and 3, the hopper 10 is provided with a bottom discharge slot 12 through which material (not shown) contained within the hopper 10 passes to enter an unloading connection tube 14, as seen in FIG. 2, provided below the discharge slot 12. The discharge slot 12 is provided with first and second gate valves 16A and 16B, or other similar devices, for permitting and stopping flow of material through the discharge slot 12. For a complete description of a gate valve 16 for a railway car hopper 10, see U.S. Pat. No. 5,060,579 entitled "Sliding Hopper Outlet Gate With Plastic Upper Surface For Smooth Sliding And For Sealing The Outlet"

issued Oct. 29, 1991 to James W. Johnson, et al which is incorporated herein by reference.

As illustrated in FIGS. 1, 2, and 3, the gate valves 16A and 16B are attached to and open and close in response to rotation of first and second operating shafts 18A and 18B located parallel to the discharge slot 12 and located one on either side thereof. The first operating shaft 18A has first and second ends 20A and 22A extending respectively through first and second end panels 24A and 24B which are located on each end of the hopper 10. A second operating shaft 18B has first and second ends 20B and 22B extending respectively through the second and first end panels 24B and 24A. The first ends 20A and 20B are attached to first and second sample control handles 26A and 27A. The second ends 22A and 22B are attached to first and second control handles 26B and 27B. By turning either the first sample control handle 26A or the first control handle 26B, an operator (not shown) is able to open and close the first gate valve 16A. Similarly, by turning either the second sample control handle 27A or the second control handle 27B, the second gate valve 16B can be opened and closed.

As illustrated on the right-hand side of FIG. 1, when a shipment is in transit, the pair of control handles located adjacent the first end panel 24A, i.e. the first sample control handle 26A and the second control handle 27B, and the pair of control handles located adjacent the second end panel 24B, i.e. second sample control handle 27A and first control handle 26B, are locked in "closed" positions by means of a couple of locking end cap devices 28 only one of which is illustrated in FIG. 1. One locking end cap device 28 fits over each pair of control handles, i.e. the pair comprised of 26A and 27B and the pair comprised of 26B and 27A. Each locking end cap device 28 normally also seals one of the discharge ends 30 of the connection tube 14. As shown in FIG. 1, the discharge ends 30 extend through the end panels 24A and 24B so that one discharge end 30 is located between ends 20A and 22B and the other discharge end 30 (not visible on the right-hand side of FIG. 1 because it is covered by the locking end cap device 28) is located between ends 20B and 22A.

When the shipment arrives at its designation, the locking end cap devices 28 must be removed from both pairs of control handles 26A and 27B, and 26B and 27A to allow the material (not shown) contained within the hopper 10 to be unloaded.

The present invention is designed to be used prior to unloading and after removing one of the locking end cap devices 28 from one pair of control handles, i.e. either 26A and 27B or 26B and 27A on either the first end 24A or the second end 24B, but prior to removing the second locking end cap device 28 from the control handles, either 26B and 27A or 26A and 27B, on the remaining end panel (24B or 24A). The present invention employs a special means of attaching ends 22A and 22B to control handles to 26B and 27B so that either of the operating shafts 18A or 18B can rotate slightly even when the control handle 26B, or 27B, that attaches to second end 22A, or 22B, is immobilized by the locking end cap device 28. Obviously, both first and second operating shafts 18A and 18B cannot be rotated simultaneously in order to obtain a sample. This is because one of the sample control handles 26A or 27A located adjacent one end panel, either 24A or 24B, must remain locked closed with its paired control handle, either 27B or 26B, located adjacent the same end panel, either 24A or 24B, for the present invention to function properly.

Figure 6:
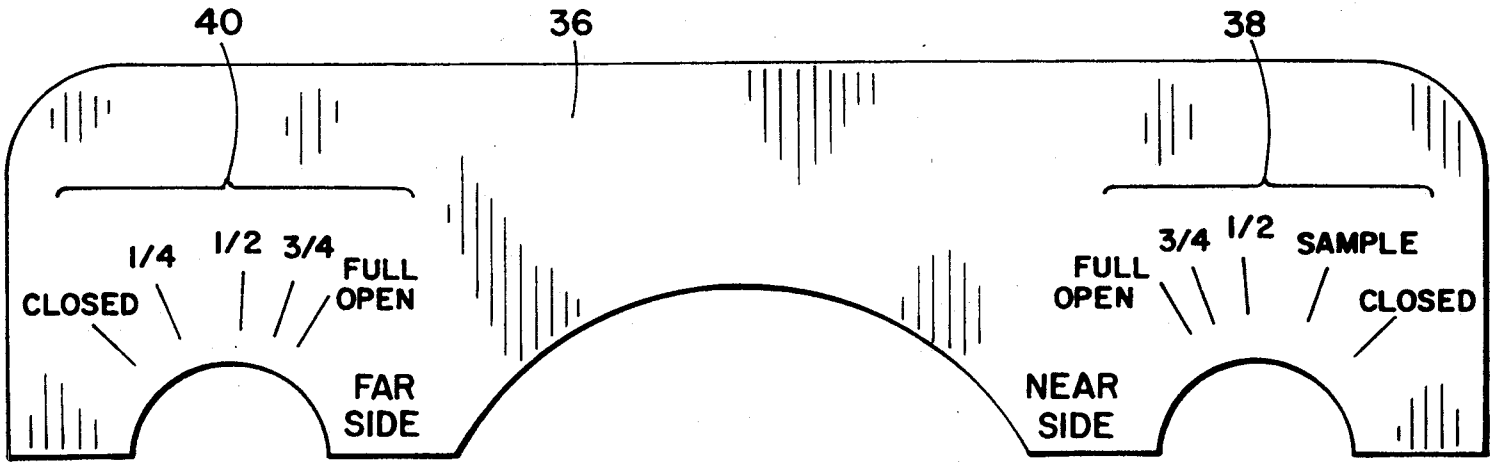
FIG. 6 is an end view taken along line 6—6 of FIG. 2 showing only the guide plate.
Figure 5:
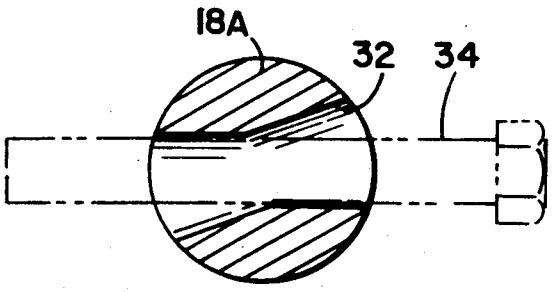
FIG. 5 is an enlarged cross-sectional view of the angled slot taken along line 5—5 of FIG. 4.
Figure 4:
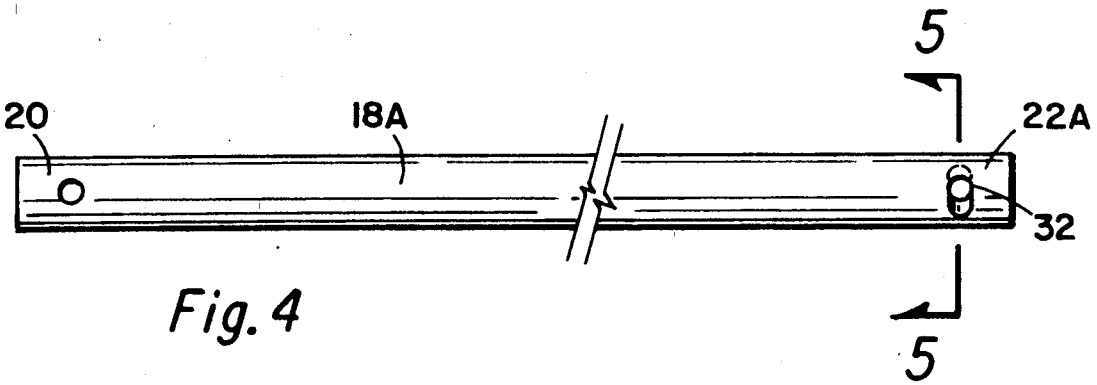
FIG. 4 is an enlarged view of an operating shaft showing an angled slot located in one end.

Referring now to FIGS. 4, 5 and 6, the first operating shaft 18A is illustrated. The second end 22A is provided with an angled slot 32 through which a bolt 34, or other suitable means of attachment, extends to secure the control handle 26B to the second end 22A. While the first control handle 26B remains locked by the locking end cap device 28, the angled slot 32 allows the first operating shaft 18A to rotate a small amount, approximately 20 radial degrees, relative to the stationary bolt 34 and relative to the attached stationary control handle 26B whenever the unlocked sample control handle 26A is turned.

As best seen in FIG. 3, by rotating a small amount, the first operating shaft 18A cracks open the associating first gate valve 16A, allowing only a small quantity of material (not shown) located within the hopper 10 to pass through the bottom discharge slot 12 into the unloading connection tube 14 from which a sample can be obtained via one of the discharge ends 30. The angled slot 32 functions to limit the rotation of the first operating shaft 18A and limits opening of the first gate valve 16A, thus, preventing partial unloading of the material (not shown) located within the hopper 10. Similarly, second control shaft 18B is provided with an angled slot 32 in its second end 22B which functions the same as previously described for the first control shaft 18A.

Attached to the first end panel 24A is a guide plate 36 provided with right-hand sample control handle indicating marks 38 corresponding to "closed", "sample", "$\frac{1}{2}$", "$\frac{3}{4}$", and "full open" positions of sample control handle 26A which controls first gate valve 16A located adjacent the first end panel 24A, i.e. the "Near Side" relative to the first end panel 24. The guide plate 36 is also provided with left-hand control handle indicating marks 40 corresponding to "closed", "$\frac{1}{4}$", "$\frac{1}{2}$", "$\frac{3}{4}$", and "full open" positions of control handle 27B which controls second gate valve 16B located adjacent the second end panel 24B, i.e. the "Far Side" relative to first end panel 24A.

Similarly, second end panel 24B is provided with a guide plate 36 with right-hand sample control handle indicating marks 38 and left-hand control handle indicating marks 40 which indicate the same positions of the second gate valve 16B in relationship to the positions of the pair of control handles 26B and 27A similar to that previously described for the first end panel 24A.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A control device for partially opening gate valves on a railway car hopper in order to obtain a sample from the hopper via the hopper's discharge slot, comprising:

at least one rotatable operating shaft associating with one of the gate valves;

means attached to each operating shaft for opening and closing its associating gate valve in response to rotation of the operating shaft;

said operating shaft having a first end and a second end, said first end being attached to a sample control handle, said second end being provided with an angled slot by which a lockable control handle is movably attached so that the operating shaft can be rotated slightly by means of the sample control handle to partially open the associating gate valve when the control handle is locked closed; and means for locking the control handle.

2. A control device according to claim 1 further comprising:

the hopper having a first end panel through which the first end of the operating shaft extends so that the sample control handle is located adjacent to the first end panel, a guide plate being provided on the first end panel, said guide plate having indicating marks coinciding with positions of the sample control handle when its associating gate valve is in various positions.

3. A control device according to claim 1 wherein two operating shafts are provided with one operating shaft being located parallel to and on either side of the hopper's discharge slot.

4. A control device according to claim 1 further comprising:

a means for locking the sample control handle.

5. A control device according to claim 1 wherein the angled slot provided in each operating shaft permits 20 radial degrees of rotation of the operating shaft when the control handle is locked closed.

6. A control device for partially opening gate valves on a railway car hopper in order to obtain a sample from the hopper via the hopper's discharge slot, comprising:

first and second rotatable operating shafts located parallel to and one on either side of the hopper's discharge slot;

means attaching to the operating shafts for opening and closing associating gate valves in response to rotation of the operating shafts;

each said operating shaft having a first end and an opposite second end, said first end of the first operating shaft and said second end of the second operating shaft extending through a first end panel provided on the hopper, said second end of the first operating shaft and said first end of the second operating shaft extending through a second end panel provided on the hopper opposite the first end panel, said first ends of the first and second operating shafts being attached respectively to first and second lockable sample control handles so that the first sample control handle is located adjacent to the first end panel and the second sample control handle is located adjacent to the second end panel, said second ends of the first and second operating shafts each being provided with an angled slot by which first and second lockable control handles are movably attached so that the first operating shaft can be rotated slightly by turning the first sample control handle to partially open its associating gate valve when the first control handle is locked closed or so that the second operating shaft can be rotated slightly by turning the second sample control handle to partially open its associating gate valve when the second control handle is locked closed;

a first means for locking the first sample control handle and the first control handle; and a second means for locking the second sample control handle and the second control handle.

7. A control device according to claim 6 further comprising:

at least one guide plate being provided on one of the end panels, each said guide plate having indicating marks coinciding with positions of its sample control handle and its control handle when its associating gate valve is in various positions.

8. A control device according to claim 6 wherein the angled slot provided in the first operating shaft permits the first operating shaft to rotate 20 radial degrees when the first control handle is locked closed, and the angled slot provided in the second operating shaft permits the second operating shaft to rotate 20 radial degrees when the second control handle is locked closed.

* * * * *